United States Patent [19]

Tat-Kee

[11] Patent Number: 4,730,364

[45] Date of Patent: Mar. 15, 1988

[54] DATA PROCESSOR FLUSH HINGE ASSEMBLY

[75] Inventor: Chan Tat-Kee, Kowloon, Hong Kong

[73] Assignee: Bondwell Holding Ltd., Kung Tung, Hong Kong

[21] Appl. No.: 792,497

[22] Filed: Oct. 29, 1985

[51] Int. Cl.[4] ..... E05D 1/108; E05C 17/64

[52] U.S. Cl. ..... 16/337; 16/341

[58] Field of Search ..... 16/337, 338, 339, 341; 292/275

[56] References Cited

U.S. PATENT DOCUMENTS

| | | | |
|---|---|---|---|
| 472,483 | 4/1892 | Loomis | 16/337 |
| 2,441,455 | 5/1948 | Tetzman | 16/337 |
| 2,500,280 | 3/1950 | Feldman | 16/337 |
| 4,177,540 | 12/1979 | Gorton | 16/337 |
| 4,332,056 | 6/1982 | Griffin | 16/341 |
| 4,609,234 | 9/1986 | Naniwa | 16/341 |

*Primary Examiner*—Kurt Rowan

*Attorney, Agent, or Firm*—Poms, Smith, Lande & Rose

[57] ABSTRACT

A combined flush hinge and hold-open is described for hinging a panel flush with respect to a surface, such as may be used for hinging a liquid crystal display to a portable computer. The panel is connected to the surface through a pair of hinges, which are mounted on spring-activated follower parts which lie flush with the surface when the panel is closed. Upon rotation of the panel from the closed position, a cam surface on the panel, shaped in the form of an outward spiral, cooperates with an involute surface within the recess to displace the hinge outwardly, which permits the panel to rotate past the upper edge of the recess to opening angles greater than 90 degrees relative to the closed position, including up to 180 degrees. The panel is held open in the selected angular position by means of the frictional fit between an O-ring and the end of a bearing which is rotatably retained within the follower to compress the O-ring between it and the follower such that the frictional resistance between the bearing and the follower may be adjusted to control the holding force on the panel.

11 Claims, 10 Drawing Figures

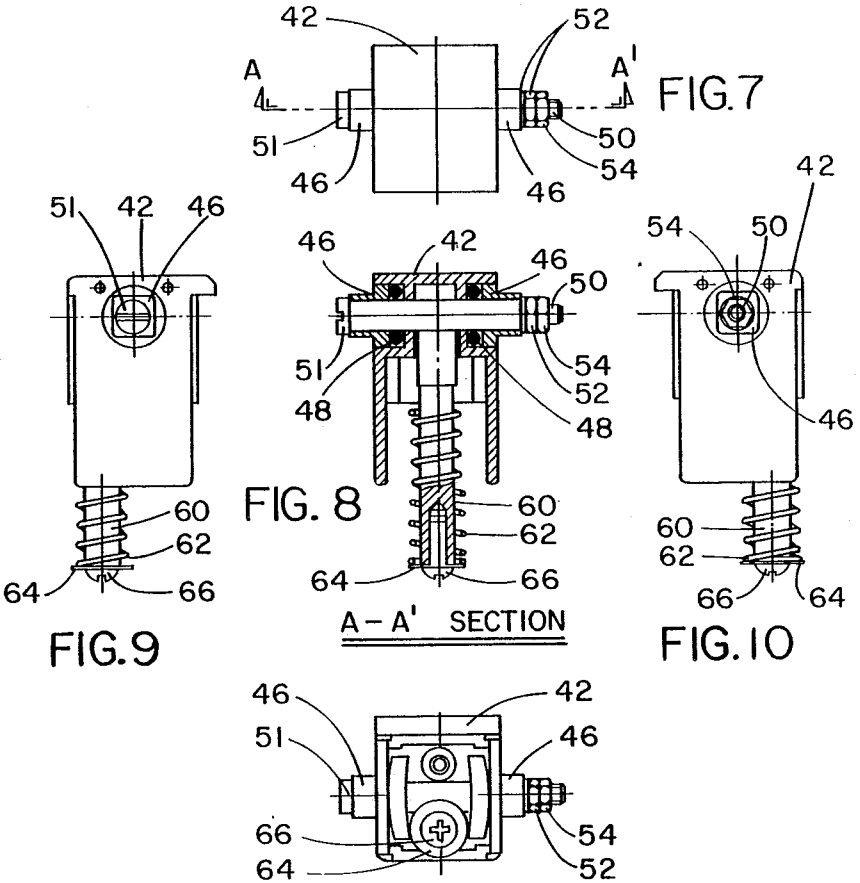
FIG. 7
FIG. 8
FIG. 9
FIG. 10
FIG. 6
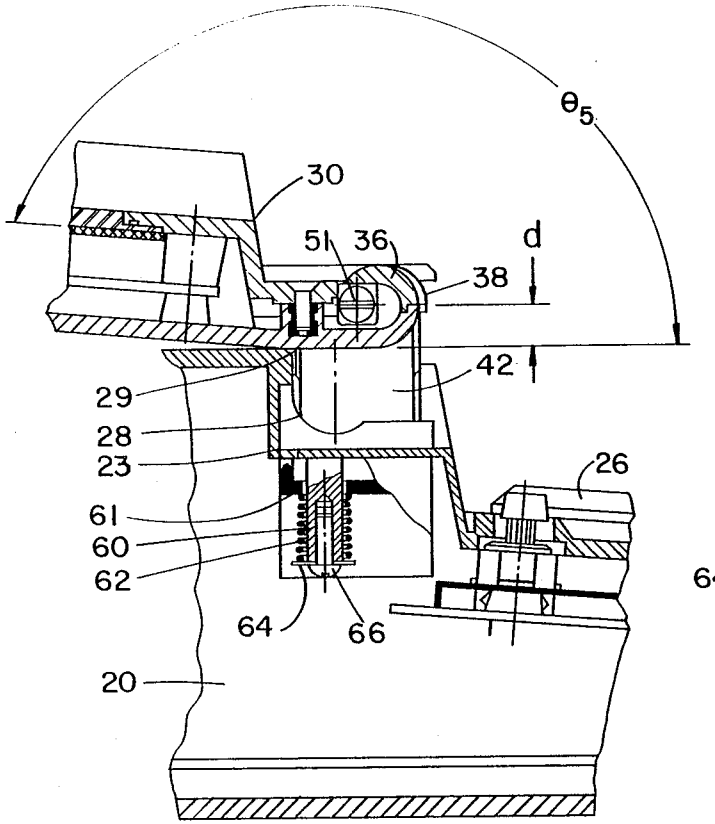
FIG. 5

DATA PROCESSOR FLUSH HINGE ASSEMBLY

FIELD OF THE INVENTION

This invention relates, in general, to data processors having displays, and to hinging hardware for a computer display panel, cover, door or the like.

BACKGROUND OF THE INVENTION

With the recent widespread development and application of personal computing, the industry has seen an increased interest and development of personal computers which are portable. Typically, these portable computers are not much larger than a small portable typewriter, but contain their own built-in CPU (Central Processing Unit), memory, disk drives, keyboard, carrying handle and display. The latter is typically a liquid crystal display contained on one side of a panel which folds down flat on the upper surface of the computer and serves as a cover to protect the keyboard and the display during storage and traveling.

For cosmetic as well as functional reasons, it is desirable that the display panel, including hinging hardward, fold to be flush with the upper surface of the computer, and this is typically accomplished by accommodating the panel within a stepped recess within the computer upper surface in which the keyboard is also located.

Ergonometrically, it is desirable for the keyboard to be slanted upwards slightly, relative to the horizontal plane so that the operator can manipulate the keys with facility. Similarly, it is desirable that the display fold open to a position somewhat greater than the vertical plane, i.e., to an angle of about 120–140 degrees, both to permit the operator seated before the machine to view the screen without crouching, and to position the screen properly for liquid crystal reflection of overhead light. Thus, it is desirable to have a flush hinge that is combined with a hold-open provision which premits the operator to rotate the screen from a fully-closed position to a first using position somewhere between about 90 degrees and 140 degrees and to retain the display in that position while the screen is viewed by the seated operator.

However, in some applications, and particularly with portable computers, it is desirable that the screen of the display be viewable by a standing operator. Thus, for example, the operator may wish to place the computer on a table or lab bench which is higher than the usual business desk and stand at that position while manipulating the computer's keyboard and viewing the dtata displayed. It is therefore also desirable for the display's hinging mechanism to permit the screen of the display to be rotated nearly all the way back, i.e., to a fully-opened angular position of nearly 180 degrees relative to the horizontal. Again, given the operator's position in front of the computer, as well as the need for properly reflecting overhead light from the liquid crystal display for adequate visibility of the characters, it is desirable that the screen be angled slightly from the horizontal, i.e., on the order of about 175 degreees for comfortable viewing by the operator.

Those skilled in the art will recognize that a simple hinge will permit a recessed display to be hinged to a position of somewhere between 0–180 degrees with little difficulty. However, in order to accomplish this, the centerline of the hinging mechanism must reside above the surface of the computer, and the advantages of having a flush surface are lost. If the hinging axis of the hinge is dropped below the surface of the computer, the display will be limited in its rotational travel by contact with upper edge of the recess at about 90 degrees maximum rotation, for a right-angle stepped recess. If the step into the recess is slanted from the vertical to permit further rotation of the display, a gap is created between the display and the computer which serves as a trap for dirt and debris and creates an unattractive appearance.

In an effort to overcome these disadvantages, some have incorporated a "double hinge" mechanism, i.e., one which hinges a pair of hinges to one another along one edge, the other edges of which are then hinged to the computer and display, respectively.

Hinges which combine a hold-open feature are known in the art. For example, U.S. Pat. No. 313,457 to Tuerk teaches a hinge for a door incorporating a convoluted spring and follower arm cooperating to hold the door in a fixed plurality of positions between a fully-opened and fully-closed position.

Thomas, in U.S. Pat. No. 2,388,021, discloses a leaf-spring in combination with a follower arm and rolling surface which serves to hold the door in an automobile in a fully opened position and, when sprung, to force the door toward the fully-closed position.

Similarly, U.S. Pat. No. 3,124,829 to DeVito teaches a hinge embodying a one-position hold-open feature.

U.S. Pat. No. 3,465,381 to Lawrie, et al., teaches a flush hinge for a cover plate on a sewing machine frame which incorporates a bifurcated spring which applies opening and closing force to the cover, depending whether the cover is in an opened or closed position.

Only two of these references teach a flush hinge; and none teaches a flush hinge combined with a hold-open provision permitting a selectable opened position between about 90 degrees and 180 degrees relative to the mounting surface. Further, none of these patents involve the unique relating to portable data-processors, as discussed above.

SUMMARY OF THE INVENTION

It is, therefore, an object of the present invention to provide a data processor assembly including a flush hinge having a hold-open provision for a panel mounted flush with a right-angled stepped recess below a mounting surface, which permits opening movement of the panel to a selectable, held position anywhere between about 90 degrees and 180 degrees, relative to the mounting surface.

It is a further object of the present invention to provide a data processor combined hinge and hold-open assembly having a holding force that is adjustable.

It is yet a further object of the present invention to provide such a hinge and hold-open that is inexpensive to fabricate, small and lightweight for portability, yet one that is reliable in operation after rigorous handling and use.

These and other objects and advantages of the present invention are preferably accomplished in accordance with a specific illustrative embodiment of the invention utilizing a hinge means attached to a spring-loaded follower retained in a recess below the surface of the computer for sliding movement inward and outward relative to the upper surface of the computer, the follower being translated outwardly by rotation of the display from a fully-closed position, which serves to rotate a cam surface formed on the surface of the display against a fixed, involute profile mounted to the computer within the recess, to raise the centerline of the hinge relative to the upper edge of the recess, whereby the panel may be opened to an angle relative to the horizontal of about 120–140 degrees. The hinge incorporates one or more O-rings sandwiched between a bushing and the follower to generate a wiping, frictional fit between the bushing and follower, which serves to hold the display in the position selected with a frictional force that is adjustable by adjustment of the degree of compression in the O-ring. The display may be opened still further to a fully-opened position of about 180 degrees by further rotation of the panel against the upper edge of the panel recess, which serves as a fulcrum with which the follower is displaced still further outwardly to raise the centerline of the hinge above the surface of the computer, thus permitting full 180 degree rotation of the display to be achieved.

In accordance with a broader aspect of the invention, a data processor having a keyboard on one side is provided with a flush, combined keyboard cover and display panel assembly mounted over the keyboard by a pair of hinging means, each including a central piston and two arms extending from the display panel which are pivotally secured to opposite sides of the piston and means for camming the piston upwardly relative to the upper surface of the processor to permit the display panel assembly to rotate through a full 180° relative to the processor upper surface, further including arrangements for holding the display at the position to which it is rotated.

A more complete understanding of the present invention may be obtained from a consideration of the following detailed description of the invention, when taken in conjunction with the included drawings, the following of which is a brief description.

BRIEF DESCRIPTION OF THE DRAWINGS

FIG. 5 is a sectional view through the side of the hinge and display showing the display folded back to a second, fuly-opened position for viewing of the screen of the display during use;

FIG. 6 is a bottom view of the follower mechanism of the present invention;

FIG. 7 is top view of the follower mechanism illustrated in FIG. 6;

FIG. 8 is a cross sectional view through the follower mechanism of FIGS. 6 and 7, as revealed by the section A–A′ taken in FIG. 7;

FIG. 9 is a side view of the left side of the follower mechanism of the present invention; and FIG. 10 is a side view of the right side of the follower mechanism of the present invention.

DETAILED DESCRIPTION

Figure 1:
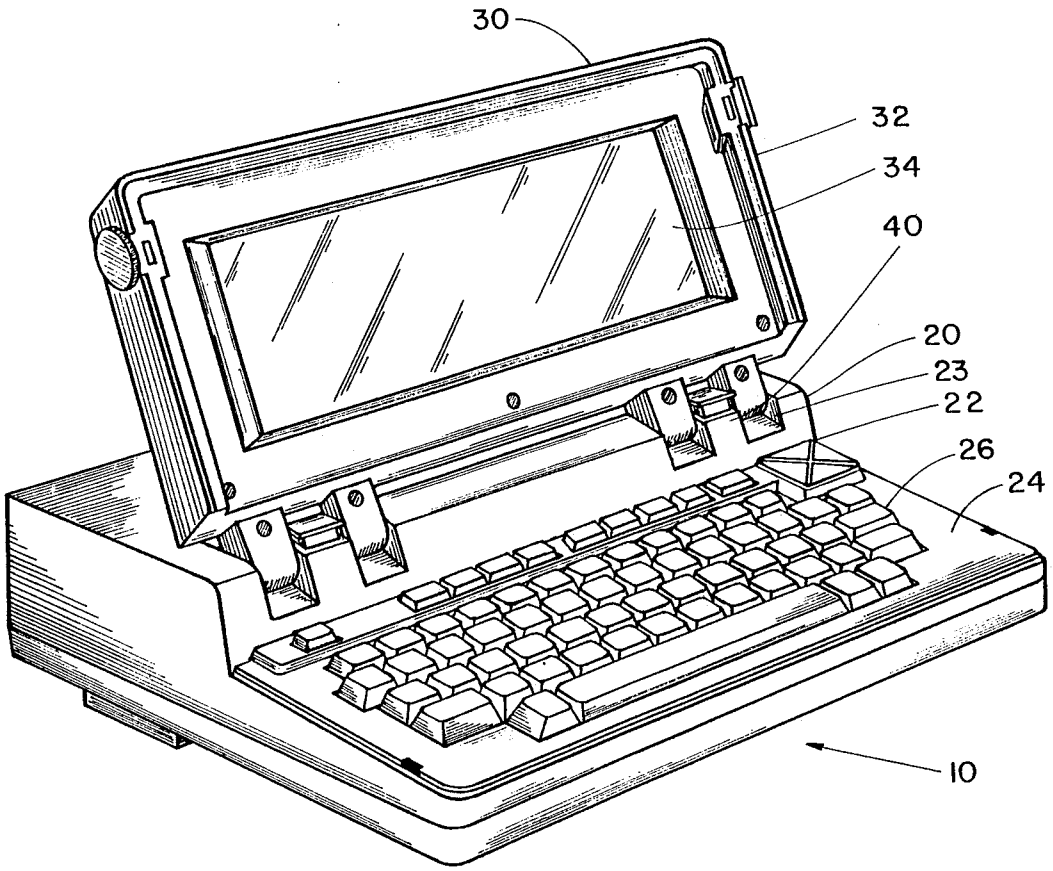
FIG. 1 is a perspective view of a portable computer having a keyboard and a folding, liquid crystal display screen folded back to a position for viewing during use.

FIG. 1 illustrates a typical, modern portable computer 10, including a processor part 20 having a stepped recess 22 in its upper surface which contains a keyboard surface 24 and a plurality of keys 26. Additionally, computer 10 typically includes a display assembly 30, including a display housing 32 housing a liquid crystal display 34 on its lower surface. Display 30 is typically higned to processor part 24 by a hinging mechanism 40, which may be disposed within a second, stepped hinge recess 23 located at the rear edge of display stepped recess 22 enabling display 30 to rotate between an opened position (illustrated), which permits viewing of liquid crystal display 34, to a fully-closed position over keyboard surface 24 to protect the keyboard surface and to provide a flush top surface of computer 10 for portability and carrying.

Figure 2:
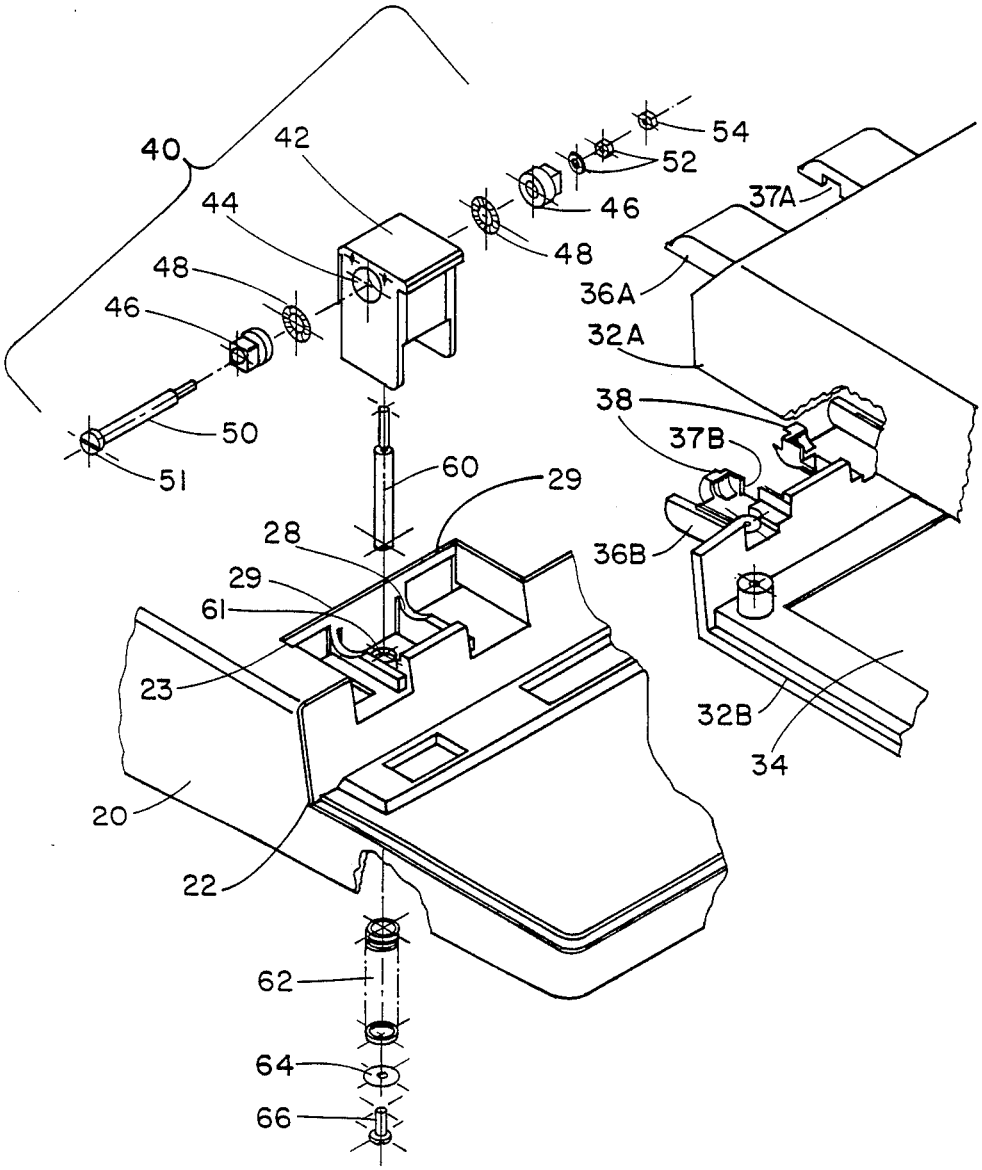
FIG. 2 is an exploded, perspective view of an exemplary, preferred embodiment of the present invention, a flush hinge and hold-open for data processors.

FIG. 2 illustrates, in an exploded perspective, an exemplary preferred embodiment of a flush hinge and hold-open for the portable computer 10.

In the preferred exemplary embodiment illustrated, display 30 comprises a pair of molded housings 32A and 32B which are assembled back-to-back to sandwich liquid crystal display 34 therebetween. Housing 32B typically contains a window or aperture in its bottom surface through which liquid crystal display 34 is viewed from the front by the operator during use. Display housings 32A and 32B each include halves of a pair of hinge parts 36A and 36B, respectively, which, when mated with one another during assembly, form a pair of hinge parts, or gudgeons 36. Molded inwardly upon opposing inner surfaces of each higne part half 36B is a cam surface 38 in the form of an outward spiral. When display 30 is in the closed position, cam s urfaces 38 reside within a pair of upwardly-concave, involute surfaces contained within a pair of pillow blocks 28 formed in the upper surface of a stepped hinge recess 23, contained within the upper surface of processor 20.

Also contained within stepped hinge recess 23 is hinge mechanism 40, which is shown exploded for clarity in FIG. 2 and assembled in the plurality of views of FIG. 6.

In the exemplary preferred embodiment, hinge mechanism 40 comprises a rectangular piston 42 containing a horizontal bore 44 therethrough having a pair of outward-facing, stepped shoulders internally which are normal to the axis of the bore. A pair of bushings 46 each compresses an O-ring between its inner end and one of the stepped shoulders contained internally within bore 44. Bushings 46 are free to rotate inside of bore 44, and include an outer portion extending outwardly from either side of piston 42 for non-rotational engagement with hinge parts 36, in the manner of a trunnion. Threaded shaft 50 passes coaxially through bushings 46, O-rings 48 and bore 44, and is retained in place by a conventional nut and washer 52.

It is to be noted that bushings 46 contact O-rings 48 in a wiping, frictional fit, which serves to hold bushings 46, and hence, display 30, in the angular position to which display 30 is rotated by the user. This frictional fit may be adjusted, within reason, by tightening or loosening of retaining nut 52, which adjusts the axial force between washer 52 and shaft head 51 exerted upon bushings 46 and O-rings 48. Locking nut 54 serves to lock the frictional fit in the subassembly after adjustment.

Piston subassembly 40 is slidably-retained within stepped hinge recess 23 in a rectangular guide contained between the pillow blocks 28 by means of a threaded shaft 60 passing through an aperture 61 through the underside of stepped hinge recess 23. A compresison spring 62 is coiled about shaft 60 and retained in place by means of a conventional washer 64 and threaded fastener 66 contained in a threaded recess in the end of shaft 60. The effect of upward translation of piston 42 relative to the upper surface of processor 20 is to compress spring 62 between washer 64 and the underside of stepped hinge recess 23.

Figure 4:
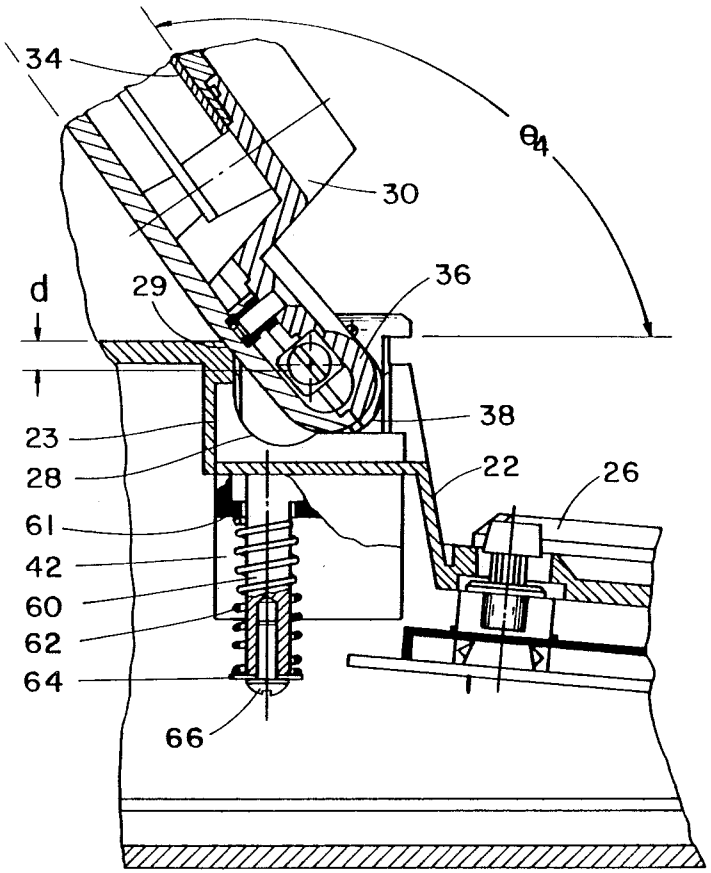
FIG. 4 is a sectional view through the side of the hinge and display of the computer with the display shown folded back to a first, predetermined angular position for viewing of the screen of the display during operation.
Figure 3:
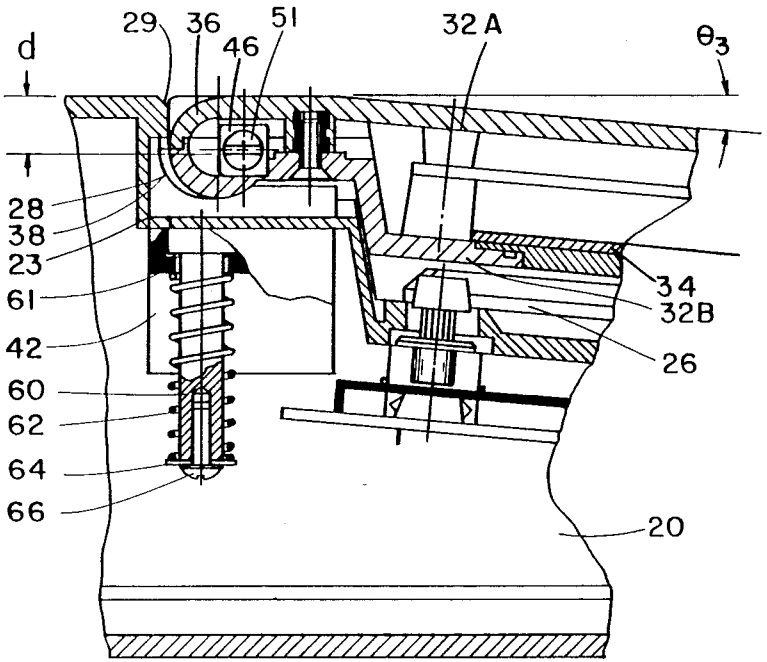
FIG. 3 is a sectional view through the side of the hinge and display of the computer, with the hinge and display in the closed, flush position.

FIGS. 3 through 5 illustrate the operation of the preferred embodiment of the hinge and hold-open of the present invention. FIG. 3 illustrates the display 30 in the fully-closed position, resting flush with the upper surface of processor 20 and over keys 26 of keyboard surface 24. In this position of display 30, the upper surface of display 30 is flush with the upper surface of processor 20, and follower subassembly 40 lies flush with both, providing a smooth, functional surface for carrying and storage. In the preferred embodiment illustrated, the keyboard surface 24 is slightly inclined with respect to the horizontal by an angle of $\theta_3$ (approx. $-5°$), and the upper surface of display 30 and liquid crystal display 34 are arranged to lie parallel with it and forward of the hinging mechanism. In this configuration, the centerline of the hinge lies below the surface of processor 20 by a distance d, camming surfaces 38 lie in substantial line contact with the concave surfaces contained in pillow brlocks 28, and compression spring 62 is relatively uncompressed.

In FIG. 4, the display is shown having been rotated through a predetermined, first angular displacement $\theta_4$ to expose the keyboard and for viewing of the liquid crystal display 34 by the user. The effect of rotation of cam surfaces 38 within pillow blocks 28 is to displace the horizontal axis through the shaft and bearings of follower subassmebly 40 upwardly, decreasing the distance d between the upper surface or processor 20 and that axis. This displacement of the hinge axis upwardly permits the display 30 to be rotated through an angle greater than 90° relative to the horizontal before the upper surface of display 30 contacts the upper edge 29 of stepped hinge recess 23, which serves as a convenient stop against which to rest display 30 in the predetermined, first angular position for viewing of display 34. In the exemplary preferred embodiment illustrated, the stopped, first angular position $\theta_4$ is controlled to be about 130°. However, it is to be noted that the angular position of display 34 is continuously adjustable by the user between from about 90° to 130° by simply tilting display 30 to the desired angular position. As may be seen in FIG. 4, the flat portion of the upper surface of pillow block 33 is engaged by cam surface 38, and a stable rest position is established.

FIG. 5 illustrates display 30 having been rotated to a fully-opened position, relative to the processor 20. This position may be desirable, for example, from the standpoint of an operator who is using computer 10 while standing. Thus, the angular position of display 30 relative to the horizontal may be as much as 180° with the present invention, and in the preferred embodiment illustrated, the angular position $\theta_5$ between liquid crystal display 34 and the horizontal is controlled to be about 175°.

It is to be noted that, in adjusting the angular position of display 30 between the first, stopped position and the fully-opened position, camming surfaces 38 no longer cooperate with the convex surfaces of the pillow blocks 28 to move the axis of follower subassembly 40 upwardly. Rather, this function is achieved by means of a "levering" of the follower subassembly 40 upward, in which the upper edge 29 of stepped hinge recess 23 serves as a fulcrum against which the lever of the upper surface of display 30 rotates to lever follower subassembly 40 further upward relative to the upper surface of processor 20 and to further compress compression spring 62. This has the effect of increasing the distance, d, between the axis of follower subassembly 40 and the upper surface of processor 20, thereby permitting the rotation of display 30 through the full 180° revolution. As before, the angular position $\theta_5$ of the display 30 may be continuously adjusted between the first, stopped position and the fully-opened position by simply tilting the display 30 to the angular position desired.

Skilled practitioners will recognize that the details of the mechanization of the hinge of the present invention, once defined by the particular application to which directed, lend themselves well to inexpensive fabrcation methods and materials. For example, in the exemplary preferred embodiment illustrated, most parts are fabricated from inexpensive, lightweight, injection-molded plastic. Compression spring 62 is fabricated from steel wirestock and heat treated to the spring rate desired, and may be a standard purchase item. In the preferred embodiment illustrated, the threaded shaft 50 is fabricated from steel rod on an automatic screw machine. The O-rings are of conventional, synthetic rubber and are available from a wide variety of sources. No lubricant is needed between the inner ends of bearing 46 and O-ring 48 if the end is provided with a relatively smooth finish.

Thus, the materials, methods of fabrication, and materials of manufacture shown and described herein are for illustrative purposes only, and others will readily suggest themselves to those practitioners confronted with other constraints. Accordingly, the invention disclosed herein should be limited in its scope and spirit only by the appended claims.

I claim:

1. A data processor assembly including a display panel mounted by a flush hinge and hold-open mechanism in a stepped recess in the upper surface of the data processor, comprising:

hinging means attached to said display panel for rotational movement thereof about a horizontal axis, relative to said data processor, to any selectable angular position between a fully-closed and a fully-opened position;

follower means slidably-retained in said computer for substantially straight-line, protractive and retractive movement relative thereto, in a direction substantially normal to said upper surface and outwardly and inwardly, respectively, relative to said surface;

means for mounting said hinging means directly on and from said follower means to shift the position of said hinging means and said display panel in the protractive and retractive directions, concurrently with the corresponding movement of said follower means in the respective protractive and retractive directions;

biasing means associated with said follower means and said computer for biasing said follower in said retractive direction downward from the data processor;

friction means rotatively-associated with said hinging means for holding said display in said selectable position relative to said computer; and camming means rotatively-associated with said display panel and said computer for shifting the position of said follower in said protractive direciton upward from the data processor and against the force of said biasing means when said display panel is moved from said fully-closed position.

2. The apparatus of claim 1, further comprising:

stopping means mounted on said data processor for stopping said rotational movement of said display in a predetermined first angular position relative to said fully-closed position and less than said fully-opened position.

3. The apparatus of claim 2, wherein:

said display is contained within a right-angle, stepped recess in said data processor upper front surface such that said display rear surface is substantially flush with said data processor upper surface when said display is in said closed position;

said stopping means further comprises line contact between said stepped recess upper edge and said display upper surface; and said predetermined first angular position is greater than 90 degrees.

4. The apparatus of claim 3, further comprising:

override means for selectably overriding said stopping means to permit said display rotational movement beyond said predetermined first angular position.

5. The apparatus of claim 4, wherein said override means further comprises:

lever-and-fulcrum means for further urging said follower means in said protractive direction and against said biasing means, whereby said stopping means is overriden.

6. The apparatus of claim 5, wherein:

the difference between said fully-open position and said fully-closed position is 180 degrees or less; and said predetermined first angular position is between about 125 degrees and 135 degrees.

7. For hinging a display panel flush within a recess contained in a surface of a data processor, a combined flush hinge and hold-open, comprising:

a journal box having a cylindrical shaft hole passing through one side about an axis parallel to said surface, a cylindrical bearing hole of larger diameter passing through the opposite side to intersect said shaft hole co-axially to form a stepped shoulder at the bottom thereof normal to said axis, said journal box being slidably-retained within said recess for inward and outward movement relative to said surface;

a spring attached to the inward side of said journal box at one end and to the underside of said surface in said recess at the other for biasing said journal box in said inward direction;

a cylindrical bearing having a cylindrical shaft hole passing co-axially therethrough, said bearing having an inner portion contained co-axially within said bearing hole for rotational movement therein, with a flat, inner end normal to said axis and opposed to said shoulder and an outer portion extending outward from said journal box;

an O-ring compressed co-axially between said bearing inner end and said bearing hole stepped shoulder for a wiping, frictional fit therebetween;

a cylindrical shaft having a head at one end and fastener means at the other, said shaft passing through said bearing shaft hole, said O-ring and said journal shaft hole, for retaining said bearing and said O-ring in said bearing hole with said shaft head and for compressing said O-ring between said bearing end and said stepped shoulder, whereby said wiping, frictional fit may be adjusted by adjustment of said fastener means;

a gudgeon attached to said panel at one edge, said gudgeon having an aperture through one side to receive said bearing outer portion therein without relative rotation, for hingably-attaching said panel to said journal box, said gudgeon having an outwardly-convex, spiral surface about an axis parallel with said bearing hole axis; and a pillow block mounted in said recess, having an upwardly-concave, involute profile in sliding contact with said gudgeon spiral surface, for forcing said gudgeon outwardly and against said spring when said panel is rotated out of said recess, whereby said panel may be rotated to a selectable, angular position between 90 and 135 degrees relative to said surface before contacting said recess upper edge, and said panel is held in said selectable position by said wiping, frictional fit.

8. The apparatus of claim 7, further comprising:

said journal box having a pair of said bearing holes, each passing co-axially through opposite sides thereof;

a pair of said cylindrical bearings, each having a portion contained within one of said bearing holes;

a pair of O-rings, each being sandwiched between one of said bearing ends and one of said bearing hole stepped shoulders;

said shaft passing through each said bearing shaft holes, said O-rings and said journal box shaft hole to retain said bearings and said O-rings in said journal box and to compress said O-rings therebetween;

a pair of said gudgeons disposed on opposite sides of said journal box, each receiving one of said bearing outer portions therein without relative rotation; and a pair of said pillow blocks, each in sliding contact with one of said gudgeon spiral surfaces.

9. The apparatus of claim 7 wherein:

said journal block may be levered outwardly by pivotal movement of said panel about said recess upper edge, whereby said panel may be rotated to a selectable angular position between 90 and 180 degrees relative to said surface.

10. A portable data processor or computer and display, comprising:

a data processor having an upper surface and a keyboard extending from one side of said computer;

a combined keyboard cover and display panel assembly mounted over said keyboard to form a continuous, flush, and substantially flat surface with the upper surface of said computer;

means for hinging said cover and said display panel asseembly for rotation through 180° so that the user may view the display at any desired angle;

said hinging means including two spaced hinge assemblies, each said hinge assembly including a central piston and two arms extending from said display panel assembly and pivotally secured to said central piston to move up and down with said piston;

means for camming said piston upwardly relative to said computer as said display panel is rotated, and means for holding said panel at any desired angle set by the user.

11. A data processor as defined in claim 10 wherein said piston is fully retracted and said hinging means is flush with the upper surface of said data processor and display where the display is closed.

* * * * *